US006383059B1

(12) United States Patent
Gotcher

(10) Patent No.: US 6,383,059 B1
(45) **Date of Patent: *May 7, 2002**

(54) POLISHING CHUCKS, SEMICONDUCTOR WAFER POLISHING CHUCKS, ABRADING METHODS, POLISHING METHODS, SEMICONDUCTOR WAFER POLISHING METHODS, AND METHODS OF FORMING POLISHING CHUCKS

(75) Inventor: Leland F. Gotcher, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 10 days.

This patent is subject to a terminal disclaimer.

(21) Appl. No.: 09/686,486

(22) Filed: Oct. 10, 2000

Related U.S. Application Data

(63) Continuation of application No. 09/266,411, filed on Mar. 10, 1999, now Pat. No. 6,176,764.

(51) Int. Cl.[7] ..... B24B 1/00
(52) U.S. Cl. ..... 451/41; 451/287; 451/288
(58) Field of Search ..... 451/282–288, 451/385–388, 397–398

(56) References Cited

U.S. PATENT DOCUMENTS

| | | | | |
|---|---|---|---|---|
| 3,977,130 A | | 8/1976 | Degner | |
| 4,918,869 A | * | 4/1990 | Kitta | 451/288 |
| 5,036,630 A | | 8/1991 | Kaanta et al. | |
| 5,095,661 A | | 3/1992 | Gill, Jr. et al. | |
| 5,400,547 A | | 3/1995 | Tanaka et al. | |
| 5,441,444 A | | 8/1995 | Nakajima | |
| 5,486,129 A | | 1/1996 | Sandhu et al. | |
| 5,532,903 A | | 7/1996 | Kendall | |
| 5,584,746 A | * | 12/1996 | Tanaka et al. | 451/41 |
| 5,584,751 A | | 12/1996 | Kobayashi et al. | |
| 5,588,902 A | | 12/1996 | Tominaga et al. | |
| 5,624,299 A | | 4/1997 | Shendon | |
| 5,645,474 A | * | 7/1997 | Kubo et al. | 451/287 |
| 5,724,121 A | | 3/1998 | McKinley et al. | |
| 5,730,642 A | | 3/1998 | Sandhu et al. | |
| 5,769,697 A | | 6/1998 | Nishio | |
| 5,816,900 A | | 10/1998 | Nagahara et al. | |
| 5,888,120 A | | 3/1999 | Doran | |
| 5,931,725 A | * | 8/1999 | Inaba et al. | 451/288 |
| 5,938,884 A | * | 8/1999 | Hoshizaki et al. | 451/345 |
| 6,176,764 B1 | * | 1/2001 | Gotcher | 451/41 |

* cited by examiner

*Primary Examiner*—George Nguyen
(74) *Attorney, Agent, or Firm*—Wells St. John P.S.

(57) ABSTRACT

Polishing chucks, semiconductor wafer polishing chucks, abrading methods, polishing methods, semiconductor wafer polishing methods, and methods of forming polishing chucks are described. In one aspect a polishing chuck includes a body dimensioned to hold a work piece, and a multi-positionable, force-bearing surface is positioned on the body. The surface has an undeflected position, and is bi-directionally deflectable away from the undeflected position. A deformable work piece-engaging member is disposed adjacent the force-bearing surface for receiving a work piece thereagainst. The work piece-engaging member is positioned for movement with the force-bearing surface. In another aspect, a yieldable surface is provided on the body and has a central area and a peripheral area outward of the central area. One of the central and peripheral areas is movable, relative to the other of the areas to provide both inwardly and outwardly flexed surface configurations. A porous member is provided on the yieldable surface and is positioned to receive a work piece thereagainst. The porous member is preferably movable by the yieldable surface into the surface configurations.

55 Claims, 6 Drawing Sheets

POLISHING CHUCKS, SEMICONDUCTOR WAFER POLISHING CHUCKS, ABRADING METHODS, POLISHING METHODS, SEMICONDUCTOR WAFER POLISHING METHODS, AND METHODS OF FORMING POLISHING CHUCKS

CROSS REFERENCE TO RELATED APPLICATION

This is a Continuation of U.S. patent application Ser. No. 09/266,411, filed Mar. 10, 1999, now U.S. Pat. No. 6,176,764, entitled "Polishing Chucks, Semiconductor Wafer Polishing Chucks, Abrading Methods, Polishing Methods, Semiconductor Wafer Polishing Methods, and Methods of Forming Polishing Chucks".

TECHNICAL FIELD

This invention relates to polishing chucks, to semiconductor wafer polishing chucks, to abrading methods, to polishing methods, to semiconductor wafer polishing methods, and to methods of forming polishing chucks.

BACKGROUND OF THE INVENTION

Polishing systems can typically include a polishing chuck which holds a work piece, and a platen upon which a polishing pad is mounted. One or more of the chuck and platen can be rotated and brought into physical contact with the other, whereby the work piece or portions thereof are abraded, ground, or otherwise polished. One problem associated with abrading, grinding or polishing work pieces in such systems, concerns uniformly removing or controlling the amount of material being removed from over the surface of a work piece.

Specifically, because of the dynamics involved in abrading work pieces, greater amounts of material can be removed over certain portions of a work piece, while lesser amounts of material are removed over other portions. Such can result in an undesirable abraded, ground, or polished profile. Yet, in other applications, it can be desirable to remove, somewhat unevenly, material from over certain portions of a work piece and not, or to a lesser degree over other portions of a work piece.

One challenge which has confronted those who process wafers is associated with retaining a wafer or work piece (which need not necessarily be a wafer), on the chuck when abrading or polishing the same. Because of the rotational velocities involved with such processing, the wafer can tend to slip off of the chuck during processing. One solution in the past has been to maintain vacuum pressure on the wafer during most or all of the processing of concern. That is, vacuum ports provided in the chuck to effect vacuum engagement of a wafer are essentially operated to maintain a vacuum relative to the wafer during abrading or polishing. However, such can cause dimpling of the wafer at these port locations which, in turn, can cause incomplete polishing at of the wafer.

This invention arose out of concerns associated with providing improved uniformity in abrading, grinding, and/or polishing scenarios. In particular, this invention arose out of concerns associated with providing uniformity and flexibility in the context of semiconductor wafer processing, wherein such processing includes abrading, grinding, or otherwise polishing a semiconductor wafer or work piece.

SUMMARY OF THE INVENTION

Polishing chucks, semiconductor wafer polishing chucks, abrading methods, polishing methods, semiconductor wafer polishing methods, and methods of forming polishing chucks are described. In one embodiment, a polishing chuck includes a body dimensioned to hold a work piece, and a multi-positionable, force-bearing surface is positioned on the body. The surface has an undeflected position, and is bi-directionally deflectable away from the undeflected position. A deformable work piece-engaging member is disposed adjacent the force-bearing surface for receiving a work piece thereagainst. The work piece-engaging member is positioned for movement with the force-bearing surface. In another embodiment, a yieldable surface is provided on the body and has a central area and a peripheral area outward of the central area. One of the central and peripheral areas is movable, relative to the other of the areas, to provide both inwardly and outwardly flexed surface configurations. A porous member is provided on the yieldable surface and is positioned to receive a work piece thereagainst. The porous member is preferably movable by the yieldable surface into the surface configurations. In yet another embodiment, a generally planar surface is provided on the body and positioned to receive the work piece thereagainst. The surface is movable into a non-planar, force-varying configuration in which more force can be exerted on outermost portions of a work piece during polishing than on innermost portions of a work piece. A deflector is operably connected with the surface and configured to move the surface into the non-planar configuration. A work piece-engaging expanse of material is positioned on the surface of the body and is movable thereby when the surface is moved into the non-planar, force-varying configuration.

BRIEF DESCRIPTION OF THE DRAWINGS

Preferred embodiments of the invention are described below with reference to the following accompanying drawings.

FIG. 6 is a view which is somewhat similar to the FIG. 5 view, but is one which shows a work piece mounted on a chuck in accordance with another embodiment of the invention.

FIG. 7 is a high level block diagram of an abrading system in accordance with one embodiment of the present invention.

DETAILED DESCRIPTION OF THE PREFERRED EMBODIMENTS

This disclosure of the invention is submitted in furtherance of the a constitutional purposes of the U.S. Patent Laws "to promote the progress of science and useful arts" (Article 1, Section 8).

Figure 1:
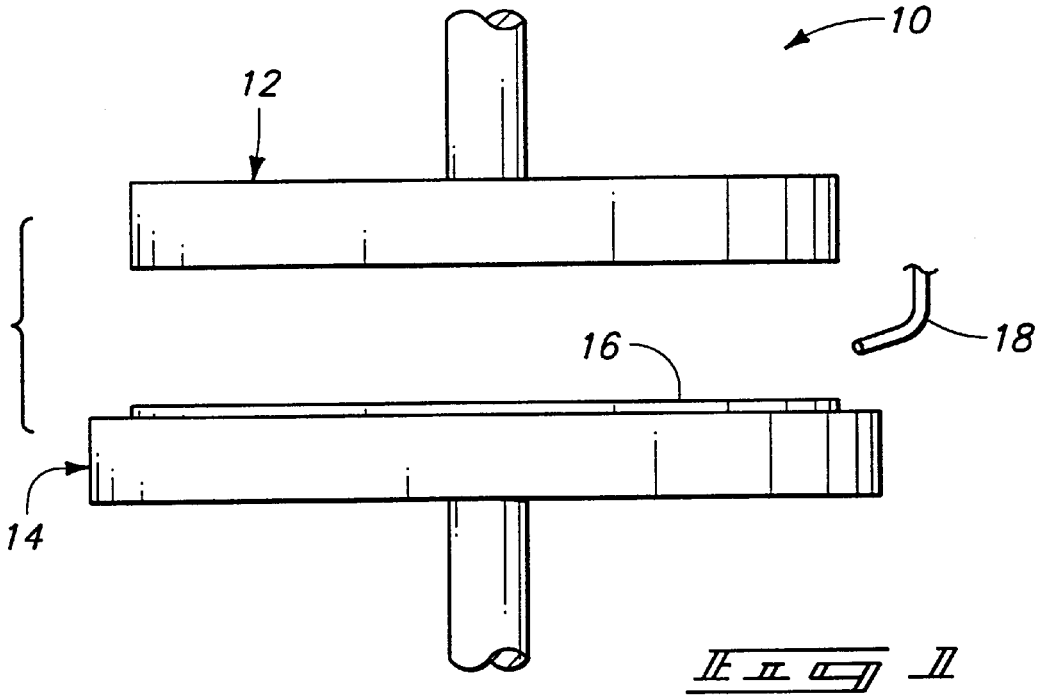
FIG. 1 is a side elevational view of one abrading system which sets forth some basic exemplary elemental features thereof.

Referring to FIG. 1, an abrading system is shown generally at 10 and includes a chuck 12, and a platen 14. A polishing pad 16 is provided and mounted on platen 14. A polishing media source 18 can be provided for delivering a polishing fluid, e.g. polishing slurry, onto polishing pad 16. Abrading system 10 is typically operated by rotating either or both of chuck 12 and platen 14 to effectuate abrading, grinding, or otherwise polishing of a work piece which is retained or held by chuck 12. In a preferred embodiment, abrading system 10 is configured to process semiconductor wafers and, accordingly, is configured as a semiconductor wafer polishing system. Other types of material can, however, be polished utilizing abrading system 10. Such materials include sheets of metal or glass, ceramic discs, or any other type of material which can be polished in accordance with principles of the invention described just below. Particular types of materials with which the invented systems and methods find utility concern those materials which are flexible to some degree. Such will become more readily apparent as the description below is read.

Figure 3:
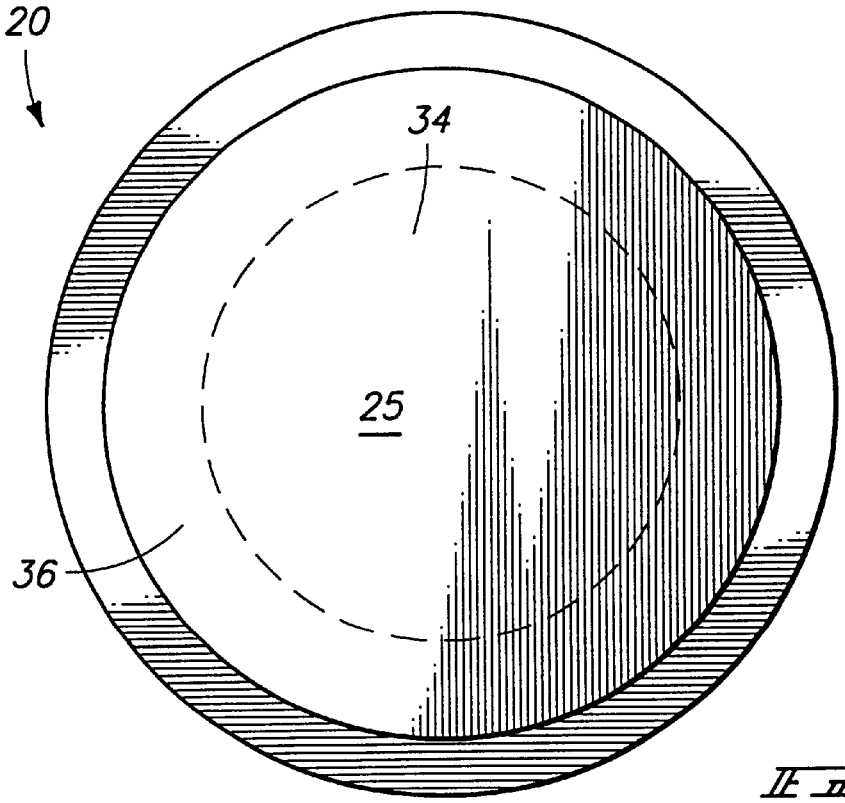
FIG. 3 is a view, from the bottom up, of an underside of a polishing chuck in accordance with one embodiment of the invention.
Figure 2:
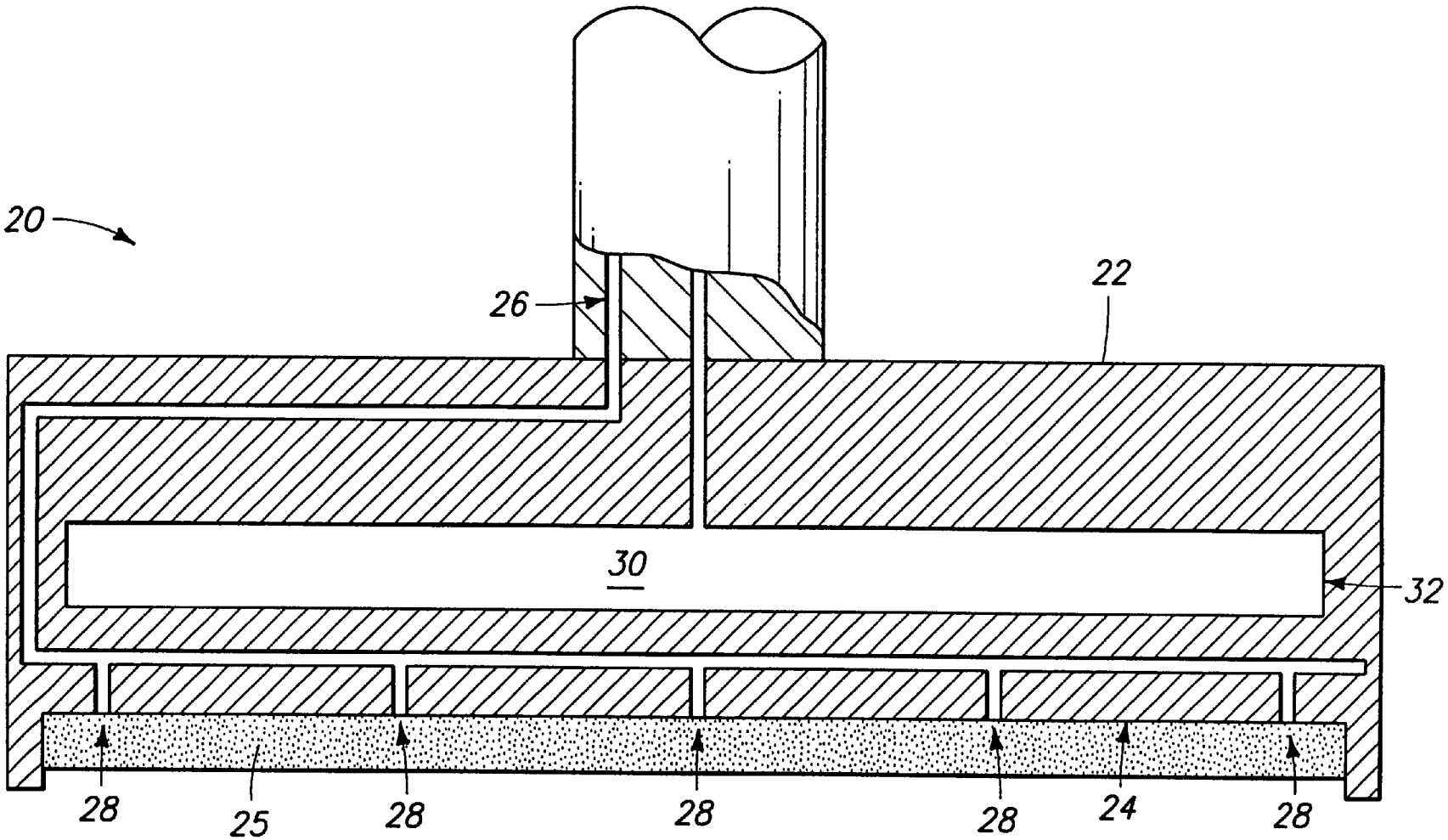
FIG. 2 is an enlarged sectional and fragmentary view of an abrading chuck in accordance with one embodiment of the invention.
Figure 4:
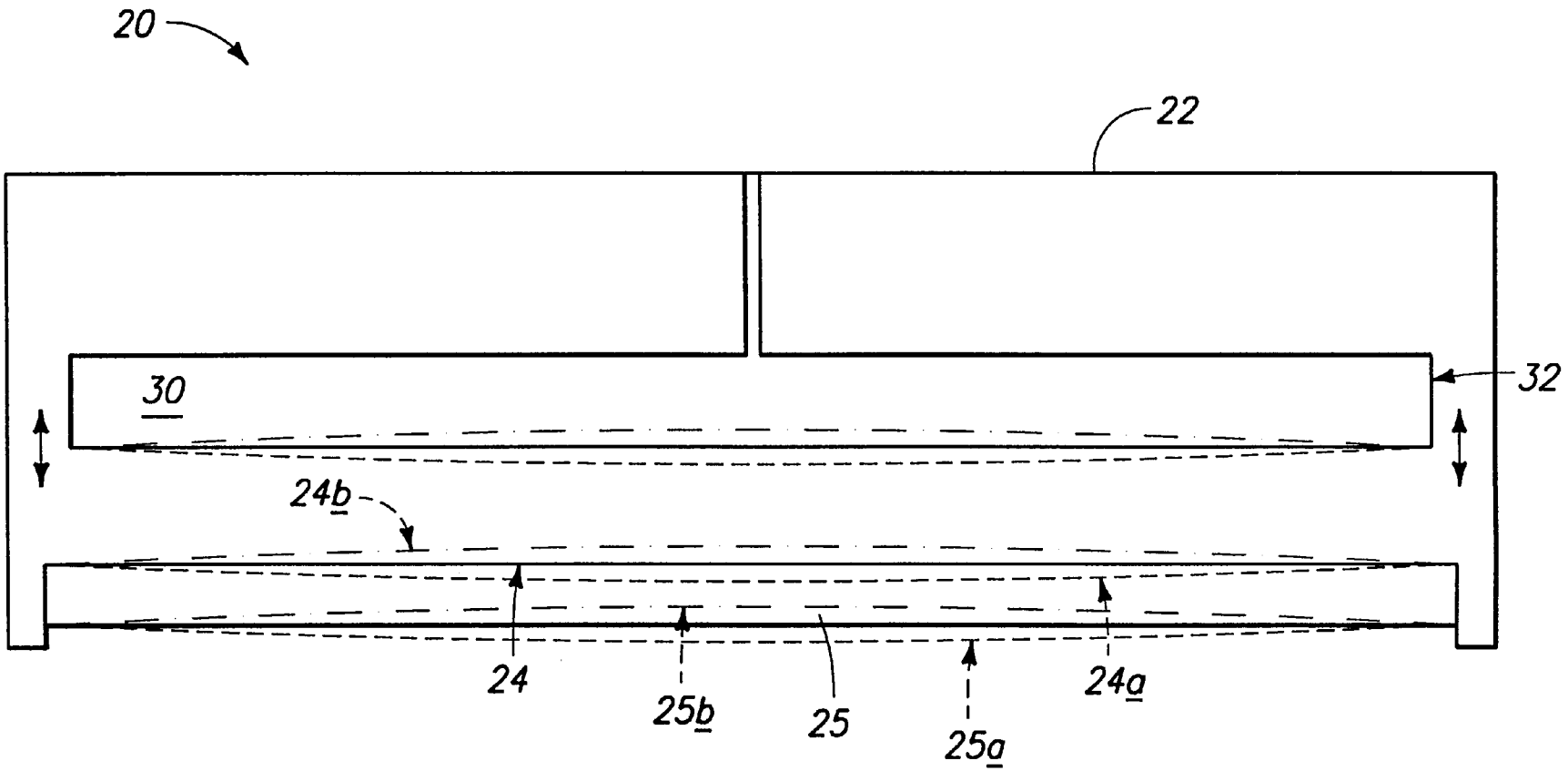
FIG. 4 is a view which is somewhat similar to the FIG. 2 view, but is one which shows certain aspects of the invention in more detail.

Referring to FIGS. 2–4, a chuck is shown generally at 20 and includes a body 22 which is dimensioned to hold a work piece which is to be abraded, ground, or otherwise polished. In a preferred embodiment, body 22 is dimensioned to receive and hold a generally planar semiconductor wafer, e.g. an eight-inch wafer. In one embodiment, chuck 20 is provided with a multi-positionable, force-bearing surface 24 which is positioned on body 22 for movement relative thereto. A deformable work piece-engaging member 25 is provided and disposed adjacent force-bearing surface 24 for receiving a work piece thereagainst. In one embodiment, work piece-engaging member 25 comprises a discrete member which is fixedly mounted on force-bearing surface 24. Optionally, it can be removably mounted on force-bearing surface 24. Mounting can take place through the use of any suitable means which is (are) suitable for use in the operating environment, e.g. epoxy, mechanical mounting, etc. Exemplary materials from which the work piece-engaging material can be formed include various ceramic, metal, or plastic materials to name just a few. Other materials can, of course, be used. Work piece engaging member 25 is positioned for movement with force-bearing surface 24 as will become apparent below. In one embodiment, work piece-engaging member 25 is generally porous. The porosity allows a more evenly-established vacuum to be established relative to a retained work piece. Exemplary and preferred thicknesses for member 25 can range from between about 0.125 to 0.5 of an inch. Other thicknesses can, of course be employed. In the illustrated example, a vacuum conduit 26 (FIG. 2) is provided and includes a plurality of outlets 28 which are used to retain a semiconductor wafer through negative vacuum pressure as will become apparent below.

In one multi-positionable embodiment, force-bearing surface 24 has an undeflected or neutral position (shown in solid lines in FIG. 4 at 24). When in the neutral position, in this example, the outer surface of work piece engaging member 25 is essentially generally planar, or otherwise generally follows the contour of surface 24. Force-bearing surface 24 is preferably bi-directionally deflectable away from the undeflected position to different positions, one of which being shown by dashed line 24*a,* the other of which being shown by dashed line 24*b*. When the force-bearing surface is placed into the illustrated deflected positions, so too is the outer surface of work piece-engaging member 25 as shown at 25*a,* 25*b* respectively.

In a preferred embodiment, deflection of force-bearing surface 24 takes place in a direction which is generally normally away from the force-bearing surface when in the undeflected position. For example, FIG. 4 shows force-bearing surface 24 in an undeflected (solid line) position. A deflected force-bearing surface is shown at 24*a* and has been deflected in a first direction which is generally normally away from force-bearing surface 24 in the undeflected position. The same can be said of the position depicted at 24*b,* only with movement taking place in the opposite direction. Deflection can take place through a range which is one micron or less away from the undeflected position.

Deflection of force-bearing surface 24 can be achieved, in but one example, in one or both of the directions, by providing a region 30 proximate force-bearing surface 24 which is expandable or contractible to displace the force-bearing surface in a particular direction. Region 30 is preferably selectively placeable into a variety of pressure configurations which act upon and thereby displace the force-bearing surface sufficiently to deflect the surface in one or more directions away from the undeflected position. In a preferred embodiment, a pressure chamber 32 is provided proximate force-bearing surface 24 and is configured to develop regions of positive and/or negative pressure sufficient to deflect surface 24. Movement of force-bearing surface 24 also moves work piece-engaging member 25 along with it as shown in FIG. 4. Pressure can be controlled through the use of gases or fluids, and can be mechanically or electronically regulated.

Figure 5:
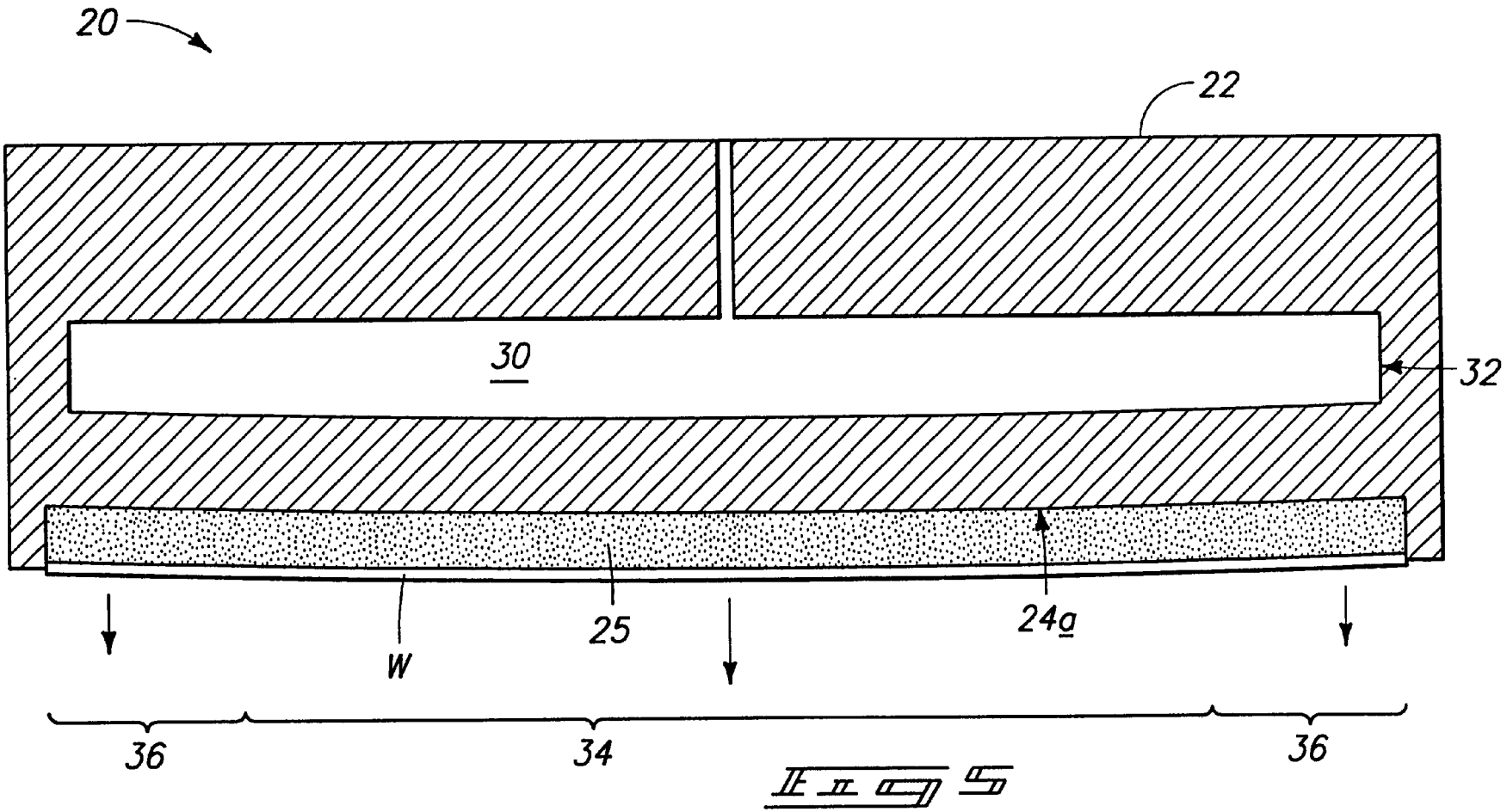
FIG. 5 is a view which is somewhat similar to the FIG. 4 view, but is one which shows a work piece mounted upon a chuck, in accordance with one embodiment of the invention.
Figure 11:
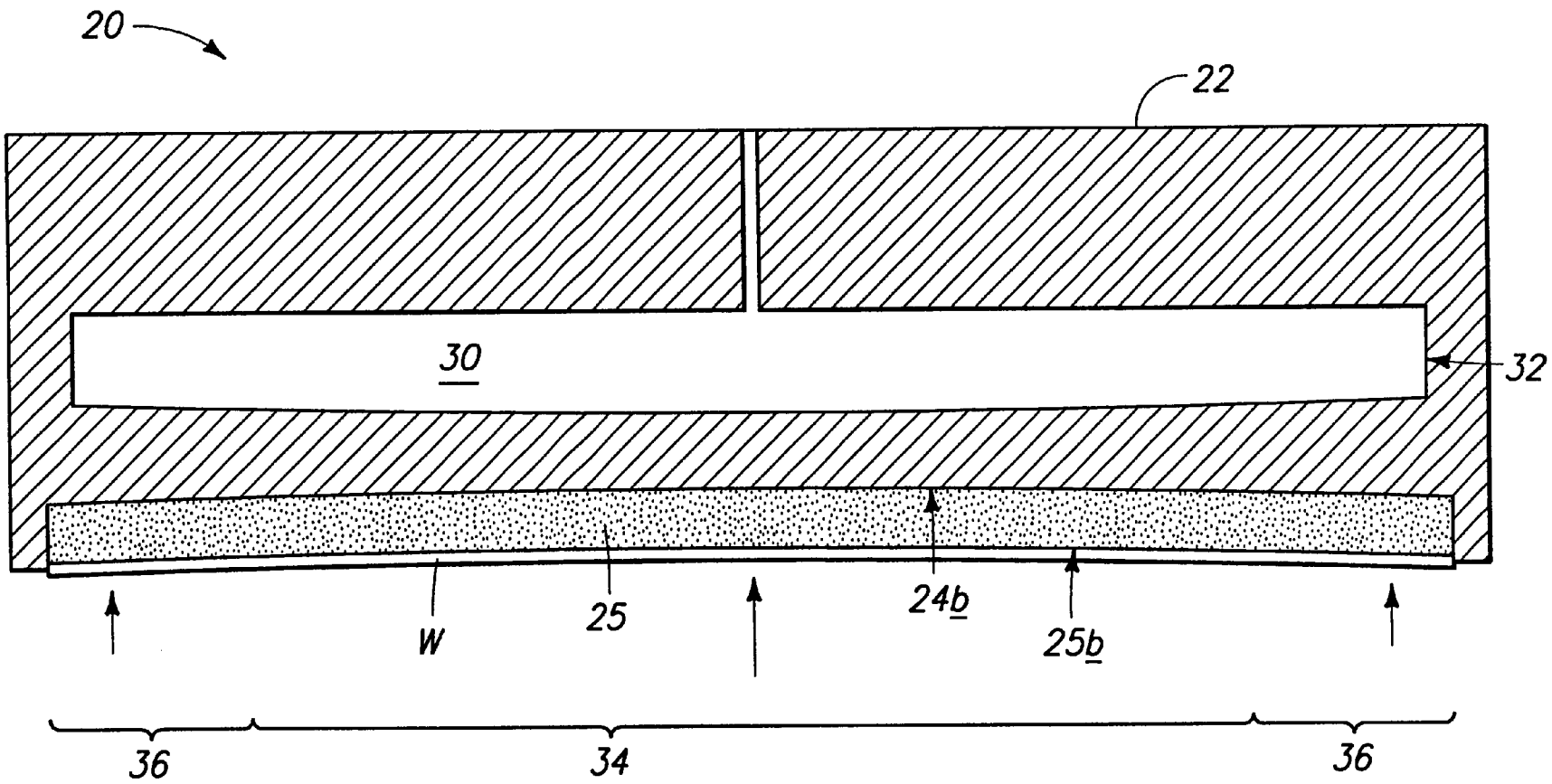
Figure 11:
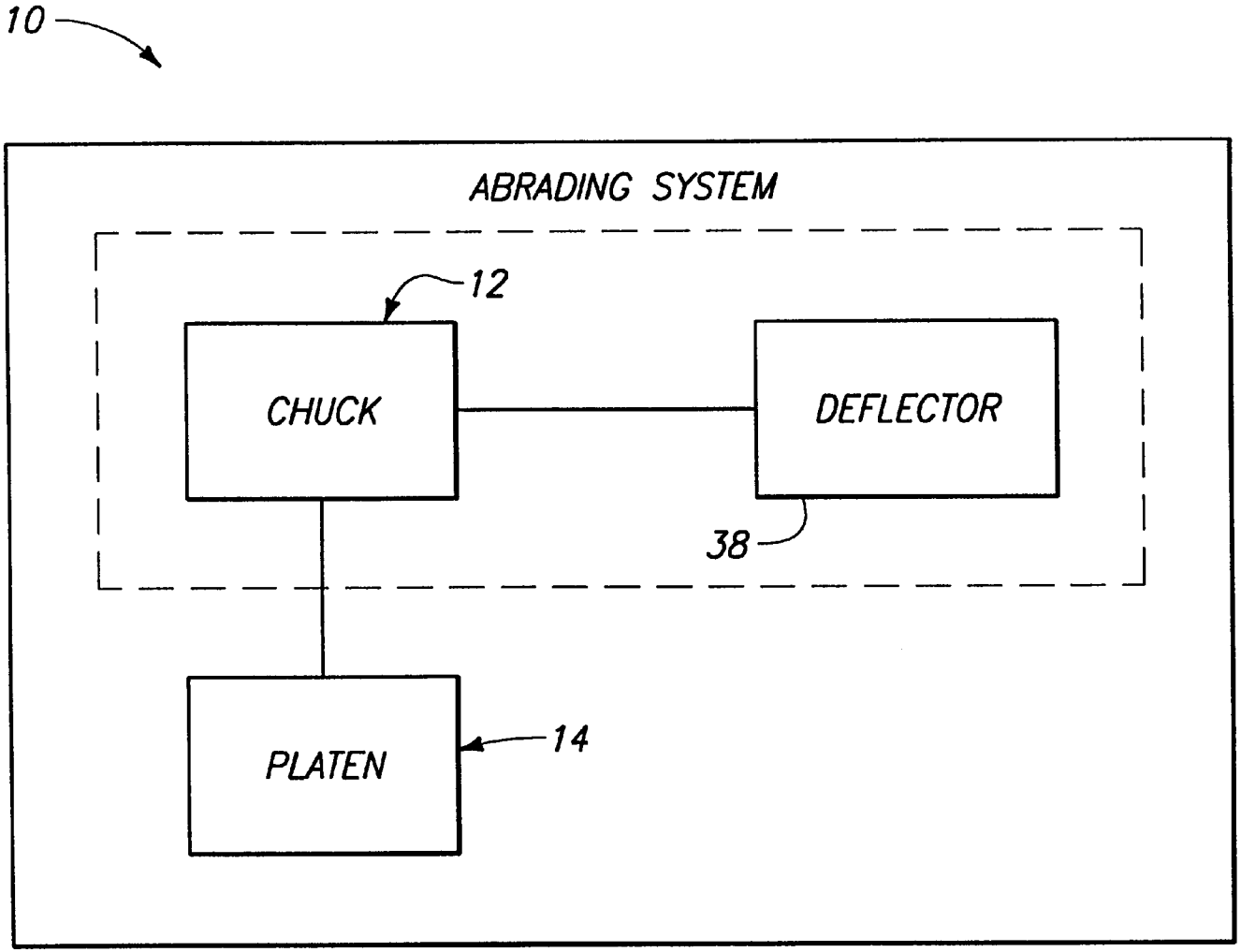

In another embodiment, a yieldable surface 24 is provided on body 22 and includes a central area 34 (FIG. 3) and a peripheral area 36 outward of central area 34. One of the central and peripheral areas 34, 36 is movable relative to the other of the areas to provide both outwardly and inwardly flexed surface configurations as shown in FIGS. 4–6. A porous member 25 is provided on yieldable surface 24 and is positioned to receive a work piece thereagainst. Preferably, porous member 25 is movable with yieldable surface 24 into the described configurations. In the illustrated and preferred embodiment, central area 34 is movable relative to peripheral area 36 to achieve the various configurations. A pressure-variable region, such as region 30, can be provided proximate the one movable area, e.g. either or both of areas 34 or 36, and configured to develop desired pressures which are sufficient to move the area(s) into the inwardly and outwardly flexed surface configurations. In the illustrated example, the pressure-variable region is provided proximate both central and peripheral areas 34, 36.

Alternately considered, surface 24 constitutes, in one embodiment, a generally planar surface on body 22 which is movable into a non-planar, force-varying configuration in which more force can be exerted on outermost portions of a work piece during polishing than on innermost portions of a work piece. An exemplary non-planar, force-varying configuration is shown in FIG. 6 where surface 24*b* is seen to bow inwardly slightly away from the center of wafer W. In this example, the non-planar, force-varying configuration is generally concave toward the work piece.

A work piece-engaging expanse of material 25 is provided and positioned on the surface of body 22. Preferably, work piece-engaging expanse 25 is movable by surface 24 of the body when the surface is moved into the non-planar, force-varying configuration. Typically with work pieces which are flexible, as semiconductor wafers are, the wafer will tend to follow the contour of the surface of expanse 25. In one embodiment, expanse 25 comprises a resilient material. Such resilient materials can, in some instances, when acted upon by vacuum outlets 28 (FIG. 3), have portions which are drawn up partially into the outlets thereby forming individual discrete vacuum pockets which each, individually engage and thereby retain a portion of the work piece being held. In another embodiment, expanse 25 comprises a porous material. Such materials can more evenly spread out an applied vacuum over the surface of a work piece, thereby minimizing or avoiding all together the problems associated with dimpling the frontside of a work piece during polishing. In another embodiment, expanse 25 comprises a resilient porous material.

In one embodiment, a deflector, such as deflector 38 (FIG. 7) is provided and is operably connected with surface 24 and configured to move the surface into the non-planar configuration. In one preferred embodiment, deflector 38 comprises a negative pressure assembly comprising a chamber, such as chamber 32, proximate surface 24 which is configured to develop negative pressures sufficient to move surface 24 into the non-planar, force-varying configuration which, in this example is generally outwardly concave.

In another preferred embodiment, deflector 38 comprises a pressure assembly comprising a chamber, such as chamber 32, proximate surface 24 which is configured to develop both negative and positive pressures which are sufficient to move surface 24 into different non-planar, force-varying configurations. In this example, the surface is movable into a second non-planar, force-varying configuration in which less force is exerted on outermost portions of the work piece by porous member 25 during polishing than on innermost portions of the work piece. Of course, with flexible wafers, the wafer would, as above, tend to follow the contour of the porous member.

In another preferred embodiment, surface 24 is movable into a plurality of configurations away from the generally planar configuration shown in solid lines in FIG. 4. These configurations can include incremental, non-planar configurations which are intermediate the generally planar (solid line) configuration shown at 24 in FIG. 4, and either or both of the non-planar configurations shown in dashed lines 24*a*, 24*b*, respectively. Accordingly, such incremental configurations can enable the force which is exerted on the outermost portions of the work piece by member 25 during polishing to be incrementally varied in accordance with the plurality of surface configurations into which the surface can be moved during polishing. In a preferred embodiment, the different non-planar, force-varying configurations can be assumed during polishing of the work piece and subsequently varied if so desired. Such provides an added degree of flexibility during the polishing of a wafer.

Alternately considered, at least a portion of surface 24 is movable in a direction away from wafer W (FIG. 6), wherein more force can be exerted by member 25 on selected wafer portions, e.g. outermost wafer portions, during polishing than on other wafer portions. At least a portion of surface 24 can also be movable in a direction toward wafer W (FIG. 5), wherein more force can be exerted by member 25 on selected wafer portions, e.g. innermost wafer portions, than other wafer portions. Surface 24 can also be movable into a plurality of positions wherein the exerted force can be varied. Such positions can occur incrementally between the neutral or undeflected position and either or both of the deflected positions, e.g. either toward or away from the wafer. One exemplary configuration is concave toward the wafer, and another exemplary configuration is concave away from the wafer.

In yet another embodiment, a semiconductor wafer polishing chuck includes a surface 24 on body 22 at least a portion of which is deflectable, and in a preferred embodiment, a force-varying deflector 38 is provided on body 22 and is operable to move the deflectable surface portion into both concave and convex force-varying configurations. A porous member 25 is provided on surface 24 and is movable therewith for directly engaging a semiconductor wafer. In one embodiment, the force-varying deflector comprises a region, such as region 30, proximate the surface portion which is selectively placeable into a variety of pressure configurations which act upon the surface portion sufficiently to move the surface portion into the concave and convex configurations. In one preferred embodiment, the force-varying deflector is operable to place the surface portion into a plurality of intermediate configurations between the concave and convex configurations. Other deflectors can be used such as mechanical actuators, pneumatically driven assemblies, piston assemblies, and the like.

Further considered, a semiconductor wafer polishing method includes mounting a semiconductor wafer on a wafer chuck having a porous wafer engaging surface. Polishing is initiated with a polishing surface and after the initiating and while polishing, the polishing force is changed between the wafer surface and the polishing surface and different polishing forces are provided for different radial locations of the wafer. In a preferred embodiment, the porous wafer-engaging surface comprises a porous member mounted on an underlying generally planar surface of the chuck.

In use, the various inventive abrading, grinding, and/or polishing systems provide for flexibility and/or uniformity before and during treatment of a work piece.

In one embodiment, a semiconductor wafer abrading method includes configuring a wafer abrading chuck, such as chuck 20, with a yieldable surface. A porous member 25 is provided on the yieldable surface for engaging a semiconductor wafer during abrading. The yieldable surface is deflectable into a generally concave configuration toward the wafer (FIG. 6) which exerts more force on a periphery of the wafer during polishing than on a center of the wafer. In a preferred embodiment, the deflecting of the yieldable surface can take place before and during polishing of the wafer, with the porous member being moved by the yieldable surface during deflection thereof.

In another embodiment, a polishing method includes providing a chuck having a body 22 dimensioned to hold a work piece which is to be polished. The polishing chuck includes a multi-positionable, force-bearing surface 24 positioned on the body. Surface 24 preferably has an undeflected position, and is bi-directionally deflectable away-from the undefected position. A deformable work piece-engaging member 25 is disposed adjacent force-bearing surface 24 for receiving a work piece thereagainst. The work piece-engaging member is positioned for movement with force-bearing surface 24. A work piece is subsequently caused to be engaged by member 25 via the multi-positionable, force-bearing surface 24. In one embodiment, surface 24 is deflected in a direction away from the work piece (FIG. 6) thereby causing outer portions of the work piece to be engaged with more force than inner portions of the work piece. In another embodiment, surface 24 is deflected in a direction away from the work piece during polishing thereof.

In other embodiments, methods of forming polishing chucks are provided. In one embodiment, a body, such as body 22, is provided and is dimensioned to hold a work piece which is to be polished. A multi-positionable, force-bearing surface, such as surface 24, is mounted on the body and preferably has an undeflected position and is bi-directionally deflectable away from the undeflected position as described above. A porous member 25 is provided on force-bearing surface 24 and is positioned to engage a work piece which is held by body 22. In one embodiment, a work piece is retained on body 22 by using porous member 25 to develop a work piece-retaining force relative to the work piece. In a preferred embodiment, the work piece-retaining force comprises a vacuum pressure as described above.

Various of the above-described embodiments can improve upon previous known methods and apparatus for effecting abrading and/or polishing of work pieces. Dimpling of the work piece frontsides can be reduced, if not eliminated thereby adding more predictability to the abrading or polishing process which, in turn, can increase yields. In addition, risks associated with a work piece becoming dislodged during processing can be reduced. Moreover, the ability to variably load a work piece during processing and thereby desirably variably polish or abrade the work piece can be enhanced.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A polishing chuck comprising:

a multi-positionable, force-bearing surface having an undeflected position and being bi-directionally deflectable away from the undeflected position; and a deformable porous work piece-engaging member disposed adjacent the force-bearing surface for receiving a work piece to be polished thereagainst, the work piece-engaging member being positioned for movement with the force-bearing surface.

2. The polishing chuck of claim 1, wherein the deformable porous work piece-engaging member comprises a discrete member fixedly mounted on the force-bearing surface.

3. The polishing chuck of claim 1, wherein the force-bearing surface is deflectable in a direction generally normally away from the force-bearing surface in the undeflected position.

4. The polishing chuck of claim 1 further comprising a region proximate the force-bearing surface, the region being selectively placeable into a variety of pressure configurations which act upon the force-bearing surface sufficiently to deflect the force-bearing surface in one direction away from the undeflected position.

5. The polishing chuck of claim 1 further comprising a pressure chamber proximate the force-bearing surface and configured to develop regions of positive and negative pressure sufficient to deflect the force-bearing surface.

6. The polishing chuck of claim 1, further comprising a body dimensioned to hold a generally flat work piece, the multi-positionable, force-bearing surface being positioned on the body for movement relative thereto.

7. The polishing chuck of claim 1, further comprising a body dimensioned to hold a semiconductor wafer, the multi-positionable, force-bearing surface being positioned on the body for movement relative thereto.

8. The polishing chuck of claim 1 further comprising a pad positioned in proximity with the force-bearing surface for abrading the work piece.

9. The polishing chuck of claim 1, further comprising a conduit configured to be coupled to the deformable porous work piece-engaging member and configured to allow a vacuum to engage the work piece with the work piece engaging member.

10. A polishing chuck comprising:

a yieldable surface having a central area and a peripheral area outward of the central area, one of the central and peripheral areas being movable relative to the other of the central and peripheral areas to provide both inwardly and outwardly flexed surface configurations; and a deformable porous member on the yieldable surface positioned to receive a work piece thereagainst and which is movable by the yieldable surface into the surface configurations.

11. The polishing chuck of claim 10, wherein the central area is movable relative to the peripheral area.

12. The polishing chuck of claim 10 further comprising a pressure-variable region proximate the one movable area and configured to develop pressures sufficient to move the one area into the inwardly and outwardly flexed surface configurations.

13. The polishing chuck of claim 10, wherein the central area is movable relative to the peripheral area, and further comprising a pressure-variable region proximate the central area and configured to develop pressures sufficient to move the central area into the inwardly and outwardly flexed surface configurations.

14. The polishing chuck of claim 10 further comprising a pressure-variable region proximate the central and peripheral areas and configured to develop pressures sufficient to move the surface into the inwardly and outwardly flexed surface configurations.

15. The polishing chuck of claim 10, wherein the central area is movable relative to the peripheral area, and further comprising a pressure-variable region proximate the central and peripheral areas and configured to develop pressures sufficient to move the surface into the inwardly and outwardly flexed surface configurations.

16. The polishing chuck of claim 10 further comprising a pad positioned in proximity with the yieldable surface for abrading the work piece.

17. The polishing chuck of claim 10, further comprising a conduit configured to be coupled to the deformable porous member and configured to allow a vacuum to engage the work piece with the deformable porous member.

18. A polishing chuck comprising:

a generally planar surface that is movable into one of a plurality of non-planar, force-varying configurations each allowing more force to be exerted on outermost portions of a work piece during polishing than on innermost portions of the work piece;

a deflector operably connected with the surface and configured to move the surface into the non-planar configuration; and a deformable, porous work piece-engaging expanse of material that is movable when the surface is moved into one of the plurality of non-planar, force-varying configurations.

19. The polishing chuck of claim 18, wherein the plurality of non-planar, force-varying configurations comprise configurations generally concave toward the work piece.

20. The polishing chuck of claim 18, wherein the deflector comprises a negative pressure assembly comprising a chamber proximate the surface and configured to develop negative pressures sufficient to move the surface into the plurality of non-planar, force-varying configurations.

21. The polishing chuck of claim 18, wherein the deflector comprises a pressure assembly comprising a chamber proximate the surface and configured to develop both negative and positive pressures sufficient to move the surface into different non-planar, force-varying configurations.

22. The polishing chuck of claim 18, wherein the plurality of non-planar, force-varying configurations comprise generally outwardly concave configurations, and the deflector comprises a negative pressure assembly comprising a chamber proximate the surface and configured to develop negative pressures sufficient to move the surface into different ones of the plurality of non-planar, force-varying configurations.

23. The polishing chuck of claim 18, wherein the surface is movable into a plurality of configurations away from the generally planar configuration, and wherein the force exerted on the outermost portions of the work piece during polishing is variable when the surface is moved into one of the plurality of non-planar, force-varying configurations.

24. The polishing chuck of claim 18, wherein the surface is movable into a second non-planar, force-varying configuration in which less force is exerted on outermost portions of the work piece during polishing than on innermost portions of the work piece.

25. The polishing chuck of claim 18, wherein the surface is movable into a second non-planar, force-varying configuration in which less force is exerted on outermost portions of the work piece during polishing than on innermost portions of the work piece, and wherein the surface is movable into a plurality of configurations away from the generally planar configuration and toward the non-planar, force-varying configurations wherein the force exerted on the outermost portions of the work piece during polishing is variable when the surface is moved into one of the plurality of non-planar force-varying configurations.

26. The polishing chuck of claim 18, wherein:

the surface is movable into a second non-planar, force-varying configuration in which less force is exerted on outermost portions of the work piece during polishing than on innermost portions of the work piece;

the surface is movable into a plurality of configurations away from the generally planar configuration and toward the non-planar, force-varying configurations wherein the force exerted on the outermost portions of the work piece during polishing is variable when the surface is moved into one of the non-planar, force-varying configurations; and the deflector comprises a pressure assembly comprising a chamber proximate the body surface and configured to develop both negative and positive pressures sufficient to move the surface into different non-planar, force-varying configurations.

27. The polishing chuck of claim 18, wherein the expanse comprises a resilient material.

28. The polishing chuck of claim 18, further comprising a conduit configured to be coupled to the deformable, porous work piece-engaging expanse of material and configured to allow a vacuum to engage the work piece with the deformable, porous work piece-engaging expanse of material.

29. A semiconductor wafer polishing chuck comprising:

a surface at least a portion of which is movable in a direction into a non-planar configuration, wherein more force is exerted by the surface on outermost wafer portions during polishing than on innermost wafer portions; and a deformable porous member positioned on the surface to engage a semiconductor wafer, the member being movable with the surface.

30. The semiconductor wafer polishing chuck of claim 29, wherein the surface portion is movable in a direction toward the wafer, wherein more force is exerted by the surface on the innermost wafer portions than on the outermost wafer portions.

31. The semiconductor wafer polishing chuck of claim 29, wherein the surface portion is movable into a plurality of positions wherein the exerted force can be varied.

32. The semiconductor wafer polishing chuck of claim 29, wherein:

the surface portion is movable in a direction toward the wafer, wherein more force is exerted by the surface on the innermost wafer portions than on the outermost wafer portions; and the surface portion is movable into a plurality of positions toward and away from the wafer wherein the exerted force is varied.

33. The semiconductor wafer polishing chuck of claim 29, wherein the surface is movable into a configuration which is concave toward the wafer.

34. The semiconductor wafer polishing chuck of claim 29, wherein:

the surface portion is movable in a direction toward the wafer, wherein more force is exerted by the surface on the innermost wafer portions than on the outermost wafer portions; and the surface is movable into configurations which are concave toward and away from the wafer.

35. The semiconductor wafer polishing chuck of claim 29 further comprising a pressure chamber proximate the surface and configured to develop a plurality of pressures sufficient to effect movement of the surface portion.

36. The semiconductor wafer polishing chuck of claim 29, wherein the surface portion is movable in a direction toward the wafer, wherein more force is exerted by the surface on the innermost wafer portions than on the outermost wafer portions, and further comprising a pressure chamber proximate the surface and configured to develop a plurality of pressures sufficient to effect movement of the surface portion.

37. The semiconductor wafer polishing chuck of claim 29, further comprising a conduit configured to be coupled to the deformable porous member and configured to allow a vacuum to engage the semiconductor wafer with the deformable porous member.

38. A semiconductor wafer polishing chuck comprising:

a surface at least a portion of which is configured to be deflectable;

a force-varying deflector operably connected with the surface, the force-varying deflector being operable to move the deflectable surface portion into both concave and convex configurations, wherein the force with which the semiconductor wafer is engaged by the surface is varied; and a deformable, porous member on the surface and movable therewith for directly engaging the semiconductor wafer.

39. The semiconductor wafer polishing chuck of claim 38, wherein the force-varying deflector comprises a region proximate the surface portion which is selectively placeable into a variety of pressure configurations which act upon the surface portion sufficiently to move the surface portion into the concave and convex configurations.

40. The semiconductor wafer polishing chuck of claim 38, wherein the force-varying deflector comprises a region proximate the surface portion which is selectively placeable into a variety of pressure configurations which act upon the surface portion sufficiently to move the surface portion into the concave and convex configurations, and a plurality of intermediate configurations between the concave and convex configurations.

41. The semiconductor wafer polishing chuck of claim 38, further comprising a conduit configured to be coupled to the deformable, porous member and configured to allow a vacuum to engage the semiconductor wafer with the deformable porous member.

42. A semiconductor wafer abrading method comprising:

providing a yieldable surface positioned to cause a semiconductor wafer to be variably loaded during abrading;

providing a deformable, porous member on the yieldable surface for engaging the semiconductor wafer during abrading; and deflecting the yieldable surface into a generally concave configuration toward the wafer which exerts more force on a periphery of a semiconductor wafer during abrading than on a center of the wafer.

43. The semiconductor wafer abrading method of claim 42, wherein the deflecting of the yieldable surface comprises deflecting the surface during abrading of the wafer.

44. The semiconductor wafer abrading method of claim 42, wherein providing a yieldable surface comprises including a conduit configured to be coupled to the wafer abrading chuck and configured to allow a vacuum to engage the semiconductor wafer with the deformable, porous member.

45. A polishing method comprising:

providing a polishing chuck having:

a multi-positionable, force-bearing surface having an undeflected position and being bi-directionally deflectable away from the undeflected position; and a deformable porous work piece-engaging member disposed adjacent the force-bearing surface for receiving a work piece thereagainst, the work piece-engaging member being positioned for movement with the force-bearing surface;

engaging a work piece with the work piece-engaging member and deforming the work piece-engaging member with the force-bearing surface.

46. The polishing method of claim 45, wherein the deforming of the porous work piece-engaging member comprises deflecting the surface in a direction away from the work piece and engaging outer portions of the work piece with more force than inner portions of the work piece.

47. The polishing method of claim 46, wherein the deflecting occurs during polishing of the wafer.

48. The polishing method of claim 45, wherein providing the polishing chuck includes providing a conduit configured to allow a vacuum to engage the work piece with the deformable porous work piece-engaging member.

49. A method of forming a polishing chuck comprising:

providing a multi-positionable, force-bearing surface having an undeflected position and being bi-directionally deflectable away from the undeflected position; and providing a deformable porous member on the force-bearing surface positioned to engage a work piece which is held on the surface.

50. The method of claim 49 further comprising providing a region proximate the force-bearing surface, the region being selectively placeable into a variety of pressure configurations which act upon the force-bearing surface sufficiently to deflect the force-bearing surface in one direction away from the undeflected position.

51. The method of claim 49 further comprising providing a pressure chamber proximate the force-bearing surface and configured to develop regions of positive and negative pressure sufficient to deflect the force-bearing surface.

52. The method of claim 49 further comprising retaining a work piece on the body by using the porous member to develop a work piece-retaining force relative to the work piece.

53. The method of claim 49, further comprising providing a body having multi-positionable, force-bearing surface thereon and further having a conduit therein configured to allow a vacuum to hold the work piece against the deformable, porous member.

54. A polishing apparatus comprising:

a chuck including:

a first force-bearing surface having an undeflected position and being bi-directionally deflectable away from the undeflected position;

a pressure chamber proximate the force-bearing surface and configured to develop regions of positive and negative pressure sufficient to deflect the force-bearing surface; and a deformable porous work piece-engaging member disposed adjacent the first force-bearing surface for receiving a work piece thereagainst, the work piece-engaging member being positioned for movement with the first force-bearing surface; and a platen, including:

a second force bearing surface disposed to frictionally engage a workpiece mounted on the deformable porous work piece-engaging member; and a polishing pad disposed on the second force bearing surface, the polishing pad being configured to frictionally engage and abrade the work piece.

55. The polishing apparatus of claim 54, further comprising a conduit configured to be coupled to the deformable porous work piece-engaging member and configured to allow a vacuum to engage the work piece with the work piece engaging member.

* * * * *

UNITED STATES PATENT AND TRADEMARK OFFICE

CERTIFICATE OF CORRECTION

PATENT NO. : 6,383,059 B1
DATED : May 7, 2002
INVENTOR(S) : Leland F. Gotcher

It is certified that error appears in the above-identified patent and that said Letters Patent is hereby corrected as shown below:

Column 6,
Line 48, replace "undefected position." with -- undeflected position. --

Signed and Sealed this

Fifteenth Day of October, 2002

*Attest:*

*Attesting Officer*

JAMES E. ROGAN
*Director of the United States Patent and Trademark Office*